US008022289B2

(12) United States Patent
Sugawara

(10) Patent No.: US 8,022,289 B2
(45) Date of Patent: Sep. 20, 2011

(54) HARMONIC SOUND GENERATOR AND A METHOD FOR PRODUCING HARMONIC SOUND

(75) Inventor: Keitaro Sugawara, Kawagoe (JP)

(73) Assignee: Pioneer Corporation, Tokyo (JP)

( * ) Notice: Subject to any disclaimer, the term of this patent is extended or adjusted under 35 U.S.C. 154(b) by 268 days.

(21) Appl. No.: 12/377,528

(22) PCT Filed: Jul. 6, 2007

(86) PCT No.: PCT/JP2007/063592

§ 371 (c)(1),
(2), (4) Date: Apr. 8, 2009

(87) PCT Pub. No.: WO2008/020515

PCT Pub. Date: Feb. 21, 2008

(65) Prior Publication Data

US 2010/0116122 A1 May 13, 2010

(30) Foreign Application Priority Data

Aug. 14, 2006 (JP) ..... 2006-220914

(51) Int. Cl.
*G10H 1/08* (2006.01)
*G10H 7/00* (2006.01)

(52) U.S. Cl. ..... 84/625

(58) Field of Classification Search ..... 84/622–625, 84/659–661

See application file for complete search history.

(56) References Cited

U.S. PATENT DOCUMENTS 7,767,899 B2 * 8/2010 Fujita ..... 84/622
2005/0245221 A1 * 11/2005 Beyer ..... 455/222

FOREIGN PATENT DOCUMENTS

| | | | |
|---|---|---|---|
| JP | 04-093998 | A | 3/1992 |
| JP | 04-116598 | A | 4/1992 |
| JP | 08-095567 | A | 4/1996 |
| JP | 08-328587 | A | 12/1996 |
| JP | 11-119780 | A | 4/1999 |
| JP | 2001-100752 | A | 4/2001 |
| JP | 2004-101797 | A | 4/2004 |
| JP | 2005-318598 | A | 11/2005 |

* cited by examiner

*Primary Examiner* — Jeffrey Donels
(74) *Attorney, Agent, or Firm* — Sughrue Mion, PLLC

(57) ABSTRACT

A first harmonic sound generating unit 1 generates a first harmonic sound signal as a product of a multiplication of a signal of a specific frequency and a signal including frequency components of odd multiples of a music signal. Then, frequency components of non-integer multiples shifted back and forth in the specific frequency from the odd multiples are generated based on the first harmonic sound signal. A full-wave rectifying unit 21 rectifies the first harmonic sound signal to generate a second harmonic sound signal including frequency components of even multiples. An adding unit 4 adds the first harmonic sound signal and the second harmonic sound signal, and then adds the additional value to the music signal.

7 Claims, 11 Drawing Sheets

HARMONIC SOUND GENERATOR AND A METHOD FOR PRODUCING HARMONIC SOUND

TECHNICAL FIELD

This invention relates to a harmonic generator and a method for producing harmonic sound.

BACKGROUND

In a sampling format of CD (Compact Disc), a sampling frequency is 44.1 kHz. Therefore, in a music signal recorded on the CD, a high frequency range over an audible frequency range of a human (20 to 200 kHz) is cut.

Further, in compressed music signals such as MP3 or WMA, a high frequency range to which a human hardly listen is cut for reducing its file size. Therefore, there is a problem that sound recorded on the CD is deteriorated by compression of music signals. Accordingly, a harmonic sound generator is proposed for restoring the high frequency range by generating harmonic sound from the music signals.

For example, in Patent Document 1, a harmonic sound adding device for separately generating even-order harmonic sound and odd-order harmonic sound and for controlling a balance between the even-order and odd-order harmonic sound is described. The even-order harmonic sound is harmonic sound including frequency components of the music sound multiplied by even numbers, namely, 2, 4, 6, 8 . . . 2n (where n is an integer). On the other hand, the odd-order harmonic sound is harmonic sound including frequency components of the music sound multiplied by odd numbers, namely, 3, 5, 7, 9 . . . 2(n+1) (where n is an integer). Further, in Patent Document 2, an acoustic signal processor for generating harmonic sound of a music sound multiplied by integer numbers using a full-wave rectifying circuit is described. Every harmonic sound generator generates harmonic sound of the frequencies of the music signal multiplied by integer numbers.

[Patent Document 1] Japanese Published Patent Application No. H08-95567

[Patent Document 2] Japanese Published Patent Application No. 2004-101797

DISCLOSURE OF THE INVENTION

Problem to be Solved by the Invention

However, it is unnecessary that the harmonic sound is made of the frequencies of the music signal multiplied by integer numbers. Sometimes they say that sound quality of an electronic musical instrument is "artificial" compared with a natural musical instrument. This is because the harmonic sound generated by the natural musical instrument includes not a little harmonic sound multiplied by non-integer, and music quality of the music signal composed of the harmonic sound multiplied by only integer generated by the electronic musical instrument includes artificiality.

Consequently, an inventor of the present invention has suggested an odd-order harmonic sound generator for generating harmonic sound including harmonic sound multiplied by non-integer numbers shifted back and forth relative to the harmonic sound multiplied by odd numbers (Japanese Patent Application No. 2006-93092). However, in this odd-order harmonic sound generator, only the harmonic sound shifted from the odd-order harmonic sound is obtained, and there is a problem that the harmonic sound multiplied by non-integer shifted back and forth relative to even-order harmonic sound cannot be obtained.

Further, we have tried to add the harmonic sound generated by the odd-order harmonic sound generator and the harmonic sound generated by an even-order harmonic sound generator which generates harmonic sound including harmonic sound multiplied by non-integer shifted back and forth relative to the harmonic sound multiplied by even number. However, the odd-order harmonic sound generator has not been realized yet. Even the odd-order harmonic generator is realized, a system for generating harmonic sound multiplied by non-integer is needed for each of odd-order and even-order harmonic sound generators. Thus, a total system becomes complex. Further, it is difficult to adjust the shift length of the harmonic sound multiplied by non-integer back and forth relative to the harmonic sound multiplied by odd numbers substantially equal to the shift length of the harmonic sound multiplied by non-integer back and forth relative to the harmonic sound multiplied by even numbers.

An object of the present invention is to solve the above-described problems. Namely, the object of the present invention is to provide a harmonic sound generator and a method for generating harmonic sound to obtain harmonic sound multiplied by non-integer shifted back and forth from both odd-order and even-order harmonic sound with a simple structure.

Means for Solving Problem

For attaining the object, according to claim 1 of the present invention, there is provided a harmonic sound generator for generating harmonic sound of a music signal comprising:

a first harmonic sound generating unit for generating a first harmonic sound signal including frequency components of non-integer multiples shifted back and forth in a specific frequency from odd-multiples of the frequency of the music signal based on the music signal; and a second harmonic sound generating unit for generating a second harmonic sound signal including frequency components of non-integer multiples shifted back and forth in the specific frequency from even multiples of the frequency of the music signal based on the first harmonic sound signal generated by the first harmonic sound generating unit, wherein the first harmonic sound generating unit is composed of:

a digital signal processor to perform a digital signal processing of the music signal and to limit the signal level to a maximum value when the signal level is larger than the maximum value of the signal level processable by the digital signal processor, and wherein the digital signal processor comprises:

a first level correcting unit to perform a level correction by multiplying the signal level of the music signal by a correction coefficient so that the signal level of the music signal is larger than the maximum value; and a second level correcting unit to perform the level correction by multiplying the signal level of the music signal corrected by the first level correcting unit by the reciprocal of the correction coefficient, and wherein the first level correcting unit comprises:

a first correction coefficient multiplying unit to multiply the signal level of the music signal by a first correction coefficient;

a second correction coefficient multiplying unit to multiply the signal level multiplied by the first correction coefficient by a second correction coefficient; and a coefficient correcting unit to correct the first correction coefficient so that the difference between the signal level multiplied by the first correction coefficient and a predetermined target value divided by the second correction coefficient becomes zero.

According to claim 4 of the present invention, there is provided a method for generating harmonic sound of a music signal comprising the steps of;

generating a first harmonic sound signal including frequency components of non-integer multiples shifted back and forth in a specific frequency from odd-multiples of the frequency of the music signal based on the music signal;

generating a second harmonic sound signal including frequency components of non-integer multiples shifted back and forth in the specific frequency from even multiples of the frequency of the music signal based on the first harmonic sound signal;

performing a digital signal processing of the music signal and limiting the signal level to a maximum value when the signal level is larger than the maximum value of the signal level processable by a digital signal processor;

performing a level correction by multiplying the signal level of the music signal by a correction coefficient so that the signal level of the music signal is larger than the maximum value;

performing the level correction by multiplying the corrected signal level of the music signal by the reciprocal of the correction coefficient, and multiplying the signal level of the music signal by a first correction coefficient;

multiplying the signal level multiplied by the first correction coefficient by a second correction coefficient; and correcting the first correction coefficient so that the difference between the signal level multiplied by the first correction coefficient and a predetermined target value divided by the second correction coefficient becomes zero.

EXPLANATIONS OF LETTERS OR NUMERALS $X_{max}$ maximum value

1 first harmonic sound generating unit (first harmonic sound generating means)

2 second harmonic sound generating unit (second harmonic sound generating means)

4 adding unit (adding means)

21 full-wave rectifying unit

12 first level correcting unit (first level correcting means)

12A first correction coefficient multiplying unit (first correction coefficient multiplying means)

12B second correction coefficient multiplying unit (second correction coefficient multiplying means)

13 coefficient correcting unit (coefficient correcting means)

14 second level correcting unit (second level correcting means)

103 DSP (harmonic sound generating means)

BEST MODE FOR CARRYING OUT THE INVENTION

Hereafter, a best mode of a harmonic sound generator according to the present invention will be explained with reference to FIGS. 1 to 3. Incidentally, FIGS. 1 to 3 are schematic views showing an embodiment of a basic configuration of the harmonic sound generator according to the present invention.

Figure 1:
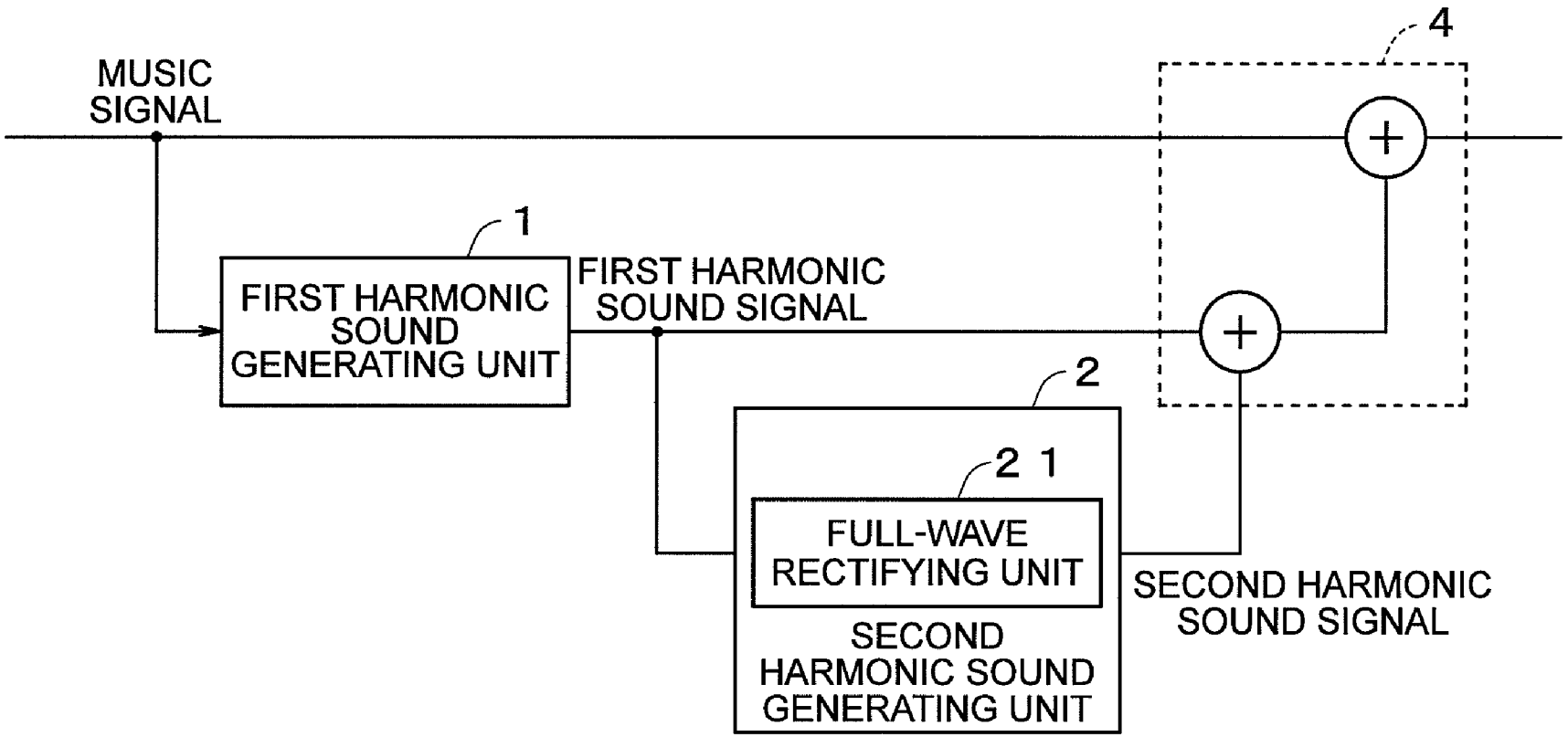
FIG. 1 A schematic view showing an embodiment of a basic configuration of a harmonic sound generator according to the present invention.
Figure 2:
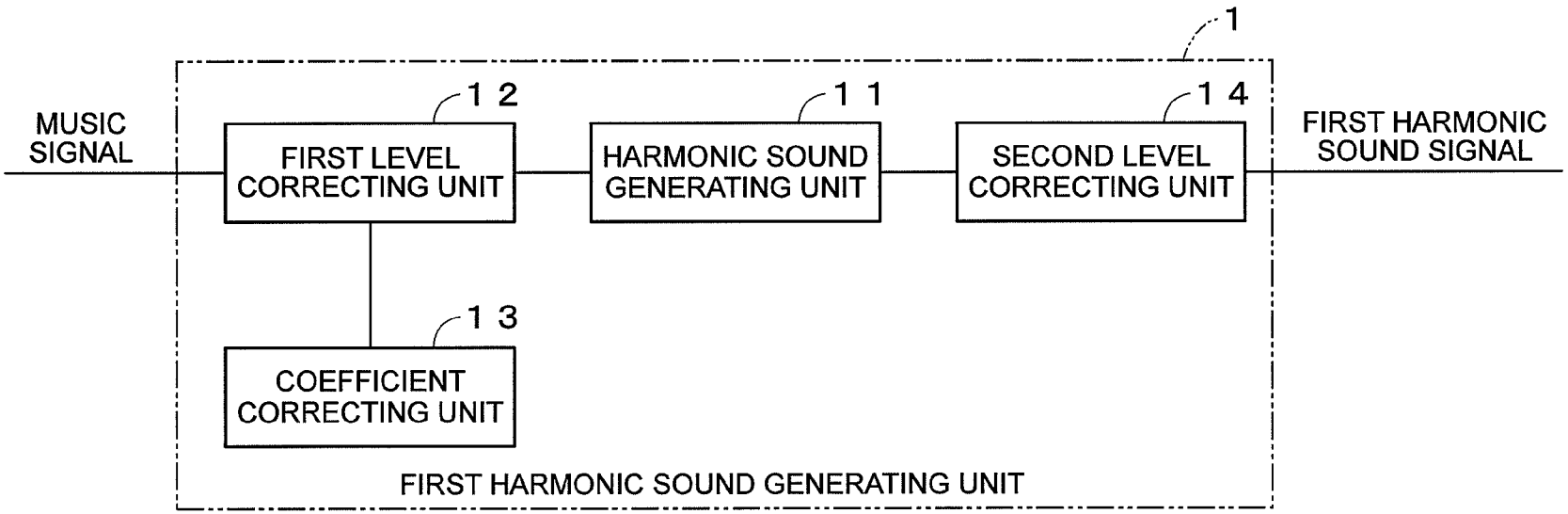
FIG. 2 A schematic view showing an embodiment of a first harmonic sound generating unit shown in FIG. 1.
Figure 3:
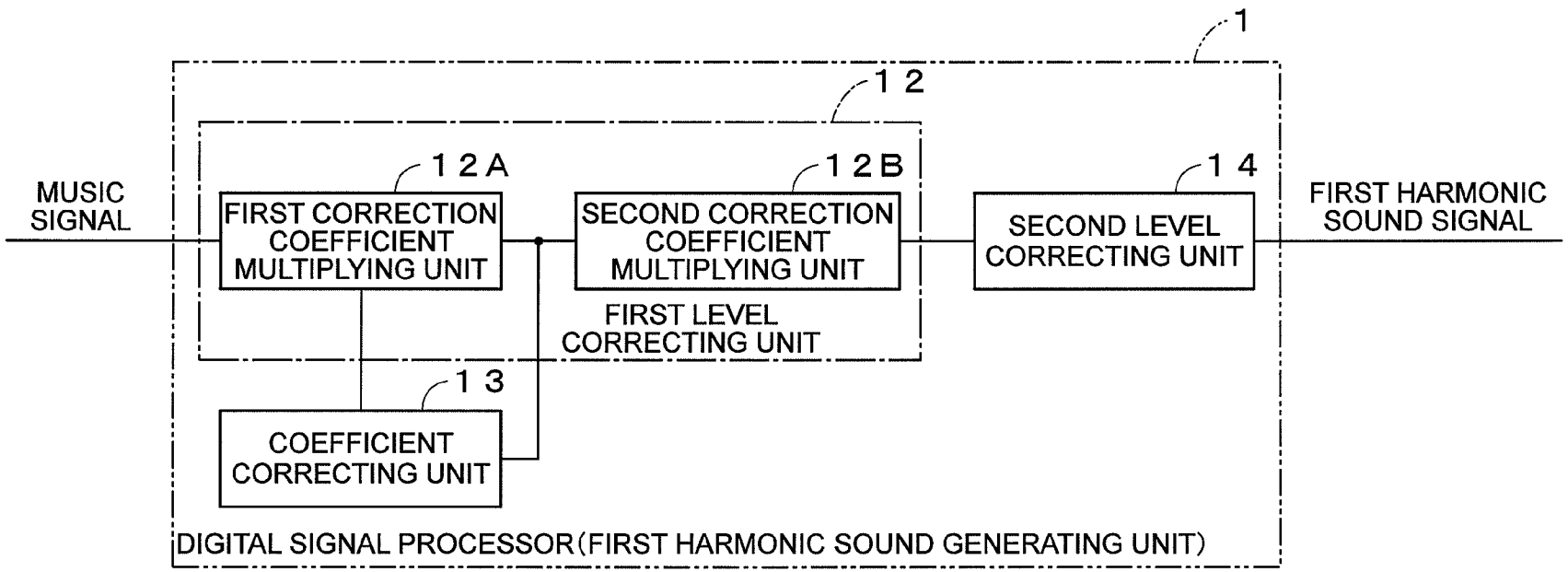
FIG. 3 A schematic view showing another embodiment of the first harmonic sound generating unit shown in FIG. 1.

In FIGS. 1 to 3, the harmonic sound generator for generating harmonic sound of a music signal includes: a first harmonic sound generating unit 1 for generating a first harmonic sound signal including frequency components of non-integer multiples shifted back and forth in a specific frequency from odd-multiples of the frequency of the music signal based on the music signal; and a second harmonic sound generating unit 2 for generating a second harmonic sound signal including frequency components of non-integer multiples shifted back and forth in the specific frequency from even multiples of the frequency of the music signal based on the first harmonic sound signal generated by the first harmonic sound generating unit, wherein the first harmonic sound generating unit 1 is composed of:

a digital signal processor to perform a digital signal processing of the music signal and to limit the signal level to a maximum value when the signal level is larger than the maximum value of the signal level processable by the digital signal processor, and wherein the digital signal processor comprises:

a first level correcting unit to perform a level correction by multiplying the signal level of the music signal by a correction coefficient so that the signal level of the music signal is larger than the maximum value; and a second level correcting unit 14 to perform the level correction by multiplying the signal level of the music signal corrected by the first level correcting unit by the reciprocal of the correction coefficient, and wherein the first level correcting unit comprises:

a first correction coefficient multiplying unit 12A to multiply the signal level of the music signal by a first correction coefficient;

a second correction coefficient multiplying unit 12B to multiply the signal level multiplied by the first correction coefficient by a second correction coefficient; and a coefficient correcting unit 13 to correct the first correction coefficient so that the difference between the signal level multiplied by the first correction coefficient and a predetermined target value divided by the second correction coefficient becomes zero.

According to the above, when the second harmonic sound generating unit 2 generates the second harmonic sound signal including the frequency components of the even multiples of the first harmonic sound signal including the frequency components of the non-linear multiples of the music signal, the second harmonic sound signal including the frequency components of the non-integer multiples shifted back and forth in the specific frequency from the even multiples of the music signal is obtained. Therefore, a configuration for generating frequency components of the non-integer multiples is only installed on the first harmonic sound generating unit 1, and it is unnecessary to install the configuration on both the first harmonic sound generating unit 1 and the second harmonic sound generating unit 2. Thus, with a simple configuration, the frequency components including the non-integer multiples of the music signal shifted back and forth from both the odd and even multiples of the music signal are obtained. Further, a shift length of the first harmonic sound signal relative to the odd multiple can be the same as that of the second harmonic sound signal relative to the odd multiple.

Further, the harmonic sound generator may include an adding unit 4 (adding means) for adding both the first and second harmonic sound signals to the music signal.

According to the above, the frequency components of the non-integer multiples shifted back and forth from both the odd and even multiples can be added to the music signal.

Further, in the harmonic sound generator, the second harmonic sound generating unit 2 may be composed of a full-wave rectifying unit 21 for full-wave rectifying the first harmonic sound signal.

According to the above, the second harmonic sound signal can be generated with a simple structure using the full-wave rectifying unit 21.

Further, as shown in FIG. 2, in the harmonic sound generator, the first harmonic sound generating unit 1 may include: a harmonic sound generating unit 11 (harmonic sound generating means) to limit a signal level over the specific value of the music signal to the specific value and to generate harmonic sound of the music signal; a first level correcting unit 12 (first level correcting means) to perform a level correction by multiplying the signal level of the music signal by a correction coefficient and then to make the harmonic sound generating means generate the harmonic sound; a coefficient correcting unit 13 (coefficient correcting means) to correct the correction coefficient so that the music signal multiplied by the correction coefficient is over the specific value; and a second level correcting unit 14 (second level correcting means) to perform the level correction by multiplying the signal level of the music signal in which the harmonic sound component is generated by the reciprocal of the correction coefficient to generate the first harmonic sound signal.

According to the above, because the correction coefficient is changed by the coefficient correcting unit 13, the first harmonic sound signal may be multiplied by the signal corresponding to the changed frequency. Therefore, frequency components of non-integer multiples shifted back and forth in the changed frequency (specific frequency) from the frequencies of the odd multiples can be generated. Further, because the signal level is over the specific level due to the level correction of the first level correcting unit 12, with respect to even the music signal of a small signal level, harmonic sound can be surely generated by limiting the signal level of the music signal by the harmonic sound generating unit 11. Namely, harmonic sound can be surely generated from even the music signal of the small signal level.

Further, in FIG. 3, in the harmonic sound generator, the first harmonic sound generating unit 1 may be composed of a digital signal processor to perform a digital signal processing of the music signal and to limit the signal level to a maximum value when the signal level larger than the maximum value of the signal level processable by the digital signal processing is generated. The digital signal processor may include: the first level correcting unit 12 (first level correcting means) to perform a level correction by multiplying the signal level of the music signal by a correction coefficient and to generate the harmonic sound; the coefficient correcting unit 13 (coefficient correcting means) to correct the correction coefficient so that the music signal multiplied by the correction coefficient is over the maximum value; and the second level correcting unit 14 (second level correcting means) to perform the level correction by multiplying the signal level of the music signal in which the harmonic sound component is generated by the reciprocal of the correction coefficient to generate the first harmonic sound signal.

According to the above, because the correction coefficient is changed by the coefficient correcting unit 13, the first harmonic sound signal may be multiplied by the signal corresponding to the changed frequency. Therefore, frequency components of non-integer multiples shifted back and forth in the changed frequency (specific frequency) from the frequencies of the odd multiples can be generated. Further, because the signal level is over the specific level due to the level correction of the first level correcting unit 12, with respect to even the music signal of a small signal level, harmonic sound can be surely generated by limiting the signal level of the music signal by the harmonic sound generating unit 11. Namely, harmonic sound can be surely generated from even the music signal of the small signal level. Further, because the harmonic sound can be generated by overflowing the DSP, the harmonic sound can be generated without making the digital signal processor arithmetic processing according to a nonlinear function. Resultingly, the harmonic sound can be generated with less arithmetic processing.

Further, in the harmonic sound generator, the first level correcting unit 12 may include: a first correction coefficient multiplying unit 12A (first correction coefficient multiplying means) to multiply the signal level of the music signal by the first correction coefficient; and a second correction coefficient multiplying unit 12B (second correction coefficient multiplying means) to multiply the signal level multiplied by the first correction coefficient by a predetermined second correction coefficient. Further, the coefficient correcting unit 13 may correct the first correction coefficient so that the difference between the signal level multiplied by the first correction coefficient and a predetermined target value divided by the second correction coefficient becomes zero.

According to the above, the coefficient correcting unit 13 corrects the first correction coefficient so that the signal level becomes (a target value/second correction coefficient) smaller than the target value. Therefore, even when the target value is set to be close to the maximum value, the signal level can be less than the maximum value at the time when the signal level is multiplied by the first correction coefficient. Resultingly, the coefficient correcting unit 13 can correct the first correction coefficient without receiving the influence of an overflow of the digital signal processor.

Further, according to an embodiment of the present invention, a method for generating harmonic sound of the music signal including the steps of: generating a first harmonic sound signal including frequency components of non-integer multiples shifted back and forth in a specific frequency from odd-multiples of the frequency of the music signal based on the music signal;

generating a second harmonic sound signal including frequency components of non-integer multiples shifted back and forth in the specific frequency from even multiples of the frequency of the music signal based on the first harmonic sound signal;

performing a digital signal processing of the music signal and limiting the signal level to a maximum value when the signal level is larger than the maximum value of the signal level processable by a digital signal processor;

performing a level correction by multiplying the signal level of the music signal by a correction coefficient so that the signal level of the music signal is larger than the maximum value;

performing the level correction by multiplying the corrected signal level of the music signal by the reciprocal of the correction coefficient, and multiplying the signal level of the music signal by a first correction coefficient;

multiplying the signal level multiplied by the first correction coefficient by a second correction coefficient; and correcting the first correction coefficient so that the difference between the signal level multiplied by the first correction coefficient and a predetermined target value divided by the second correction coefficient becomes zero.

According to the above, when generating the second harmonic sound signal including the frequency components of the even multiples of the first harmonic sound signal including the frequency components of the non-linear multiples of the music signal, the second harmonic sound signal including the frequency components of the non-integer multiples shifted back and forth in the specific frequency from the even multiples of the music signal is obtained. Therefore, a configuration for generating frequency components of the non-integer multiples is only installed on the first harmonic sound generating unit, and it is unnecessary to install the configuration on both the first harmonic sound generating unit and the second harmonic sound generating unit. Thus, with a simple configuration, the frequency components including the non-integer multiples of the music signal shifted back and forth from both the odd and even multiples of the music signal are obtained. Further, a shift length of the first harmonic sound signal relative to the odd multiple can be the same as that of the second harmonic sound signal relative to the odd multiple.

Embodiment

Figure 4:
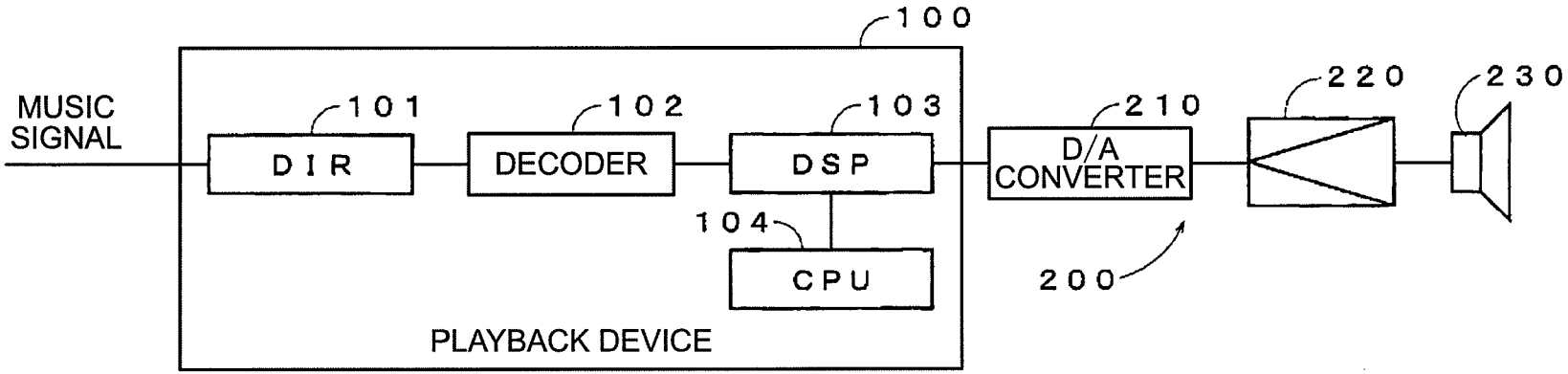
FIG. 4 A block diagram showing an embodiment of a playback device in which the harmonic sound generator according to the present invention is embedded.

Next, an embodiment of a music playback unit in which the harmonic sound generator described above is embedded will be explained. Incidentally, FIG. 4 is a schematic view showing an embodiment of a configuration of the music playback device in which the harmonic sound generator and the digital signal processor are embedded.

This music playback unit converts digital music signals recorded on a recording media such as DVD (Digital Versatile Disc), CD (Compact Disc), or a hard disk into signals to be reproduced by a speaker. An output unit 200 for reproducing processed music data is connected to this music playback unit 100.

The output unit 200 reproduce the music signal outputted from the music playback unit 100. This output unit 200 includes a digital to analog (D/A) converter 210, an amplifier 220, and a speaker 230. The D/A converter 210 is connected to the music playback unit 100, and converts the digital music signal outputted from the music playback unit 100 into the analog music signal. Then, the D/A converter 210 outputs the analog-converted music signal to the amplifier 220.

The amplifier 220 is connected to the D/A converter 210 and is also connected to the speaker 230. This amplifier 220 amplifies the analog music signal outputted from the D/A converter 210, and the speaker 230 outputs the amplified analog music signal.

The music playback unit 100 is composed of a DIR (Digital Interface Receiver) 101 into which the digital music signal read out from the above-described recording media is inputted, a decoder 102 for decoding the compressed music signal, a DSP 103 for various signal processing such as mixing or effect with respect to the decoded musical signal, and a CPU 104 for controlling the DSP 103.

The above-described DSP 103 overflows when a large signal level which is larger than the maximum value $x_{max}$ (=specific value) of the digital signal processable signal levels is generated, and clips the signal level to the maximum value $x_{max}$. Normally, the signal level of the digital music signal is less than the maximum value $x_{max}$ of the DSP 103. Incidentally, above-described signal level is an absolute value.

Figure 5:
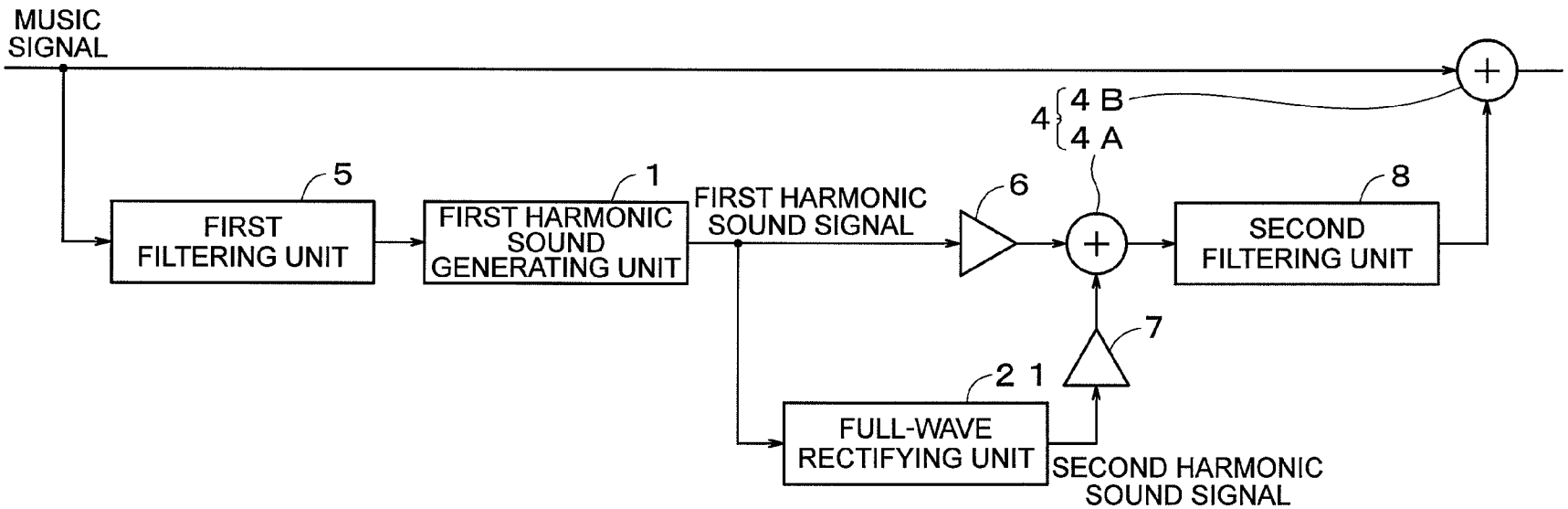
FIG. 5 A block diagram showing a structure of a DSP composing the playback device shown in FIG. 4.
Figure 6A:
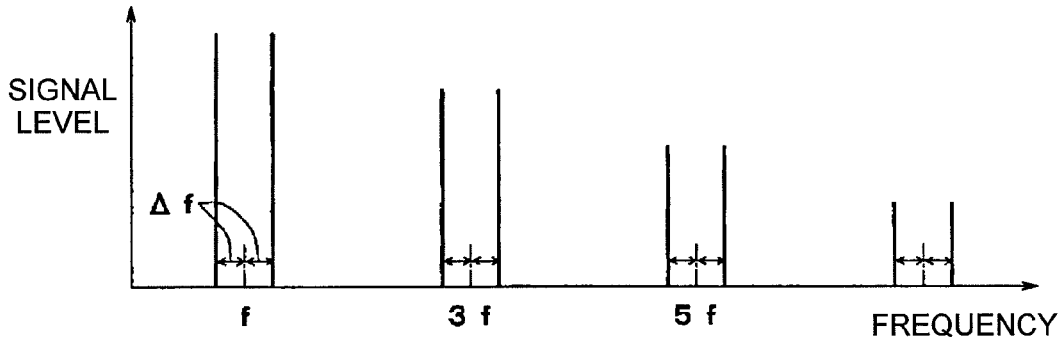
FIG. 6A A graph showing a frequency characteristic of a first harmonic sound signal generated by the first harmonic sound generating unit.

Next, a configuration of the above-described DSP 103 will be explained with reference to FIG. 5. The DSP 103 is controlled by a program stored in a not-shown memory, and is composed of a first filter 5, a first harmonic sound generating unit 1, a first amplifier 6, a full-wave rectifying unit 21, a second amplifier 7, a first adding unit 4A, a second filtering unit 8, and a second adding unit 4B. The first filtering unit 5 only extracts a specific frequency range from the music signal. The first harmonic sound generating unit 1 works as a first harmonic sound generating means, and as shown in FIG. 6A, generates a first harmonic sound signal including frequency components of non-integer multiples shifted back and forth in a specific frequency Δf from frequencies of odd multiples of the music signal f, 3f, 5f, . . . where f is a frequency of the music signal extracted by the first filtering unit 5.

Figure 6B:
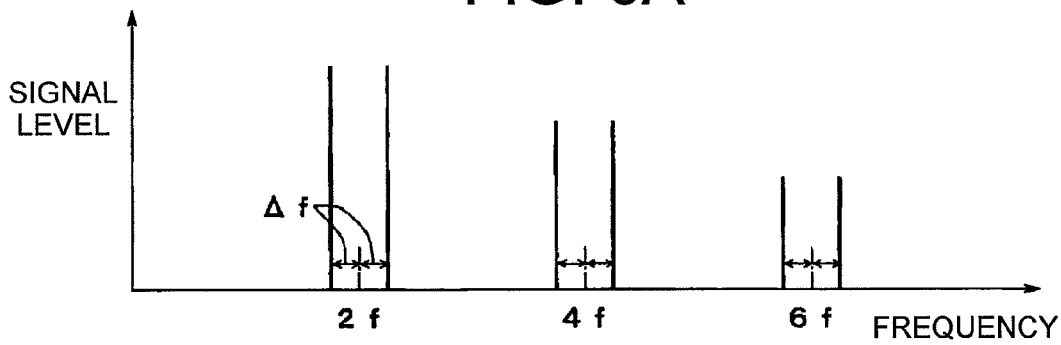
FIG. 6B A graph showing a frequency characteristic of the first harmonic sound signal outputted from a second filtering unit.

The first amplifier 6 amplifies the first harmonic sound signal. The full-wave rectifying unit 21 works as a second harmonic sound generating means, and full-wave rectifies the first harmonic sound signal before amplified to generate the second harmonic sound signal including frequency components of even multiples. As shown in FIG. 6B, when the first harmonic sound signal is full-wave rectified, the second harmonic sound signal including frequency components of non-integer multiples shifted back and forth in the specific frequency Δf from the frequencies of the even multiples 2f, 4f, . . . is generated.

Figure 6C:
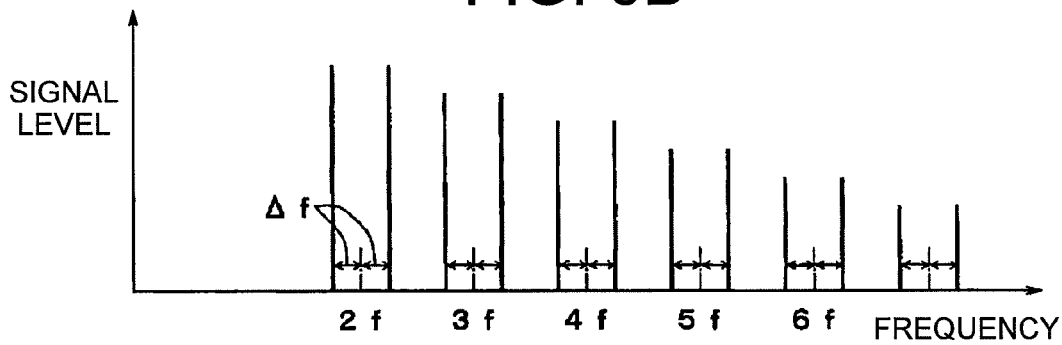
FIG. 6C A graph showing a frequency characteristic of a second harmonic sound signal.
Figure 6D:
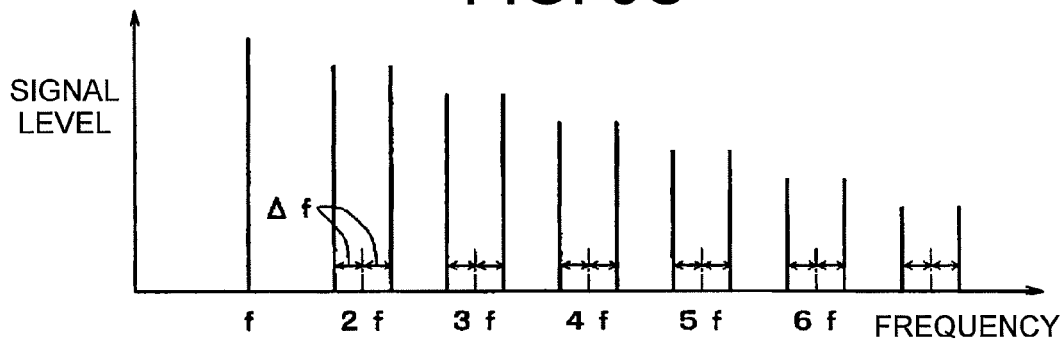
FIG. 6D A graph showing a frequency characteristic of a music signal which is a sum of the first and second harmonic sound signals.

The second amplifier 7 amplifies the second harmonic sound signal. The first adding unit 4A adds the first and second harmonic sound signals. As shown in FIG. 6C, the second filtering unit 8 only extracts the harmonic sound from the sum of the first and second harmonic sound signal by eliminating the specific frequency range. The second adding unit 4B adds the output signal of the second filtering unit 8 as shown in FIG. 6C to the music signal, and as shown in FIG. 6D, obtains frequency components of non-integer multiples shifted back and forth in the specific frequency Δf from both the odd and the even multiples 2f, 3f, 4f, . . . . Incidentally, the first and second adding units 4A, 4B compose the adding unit 4 as the adding means.

Figure 7:
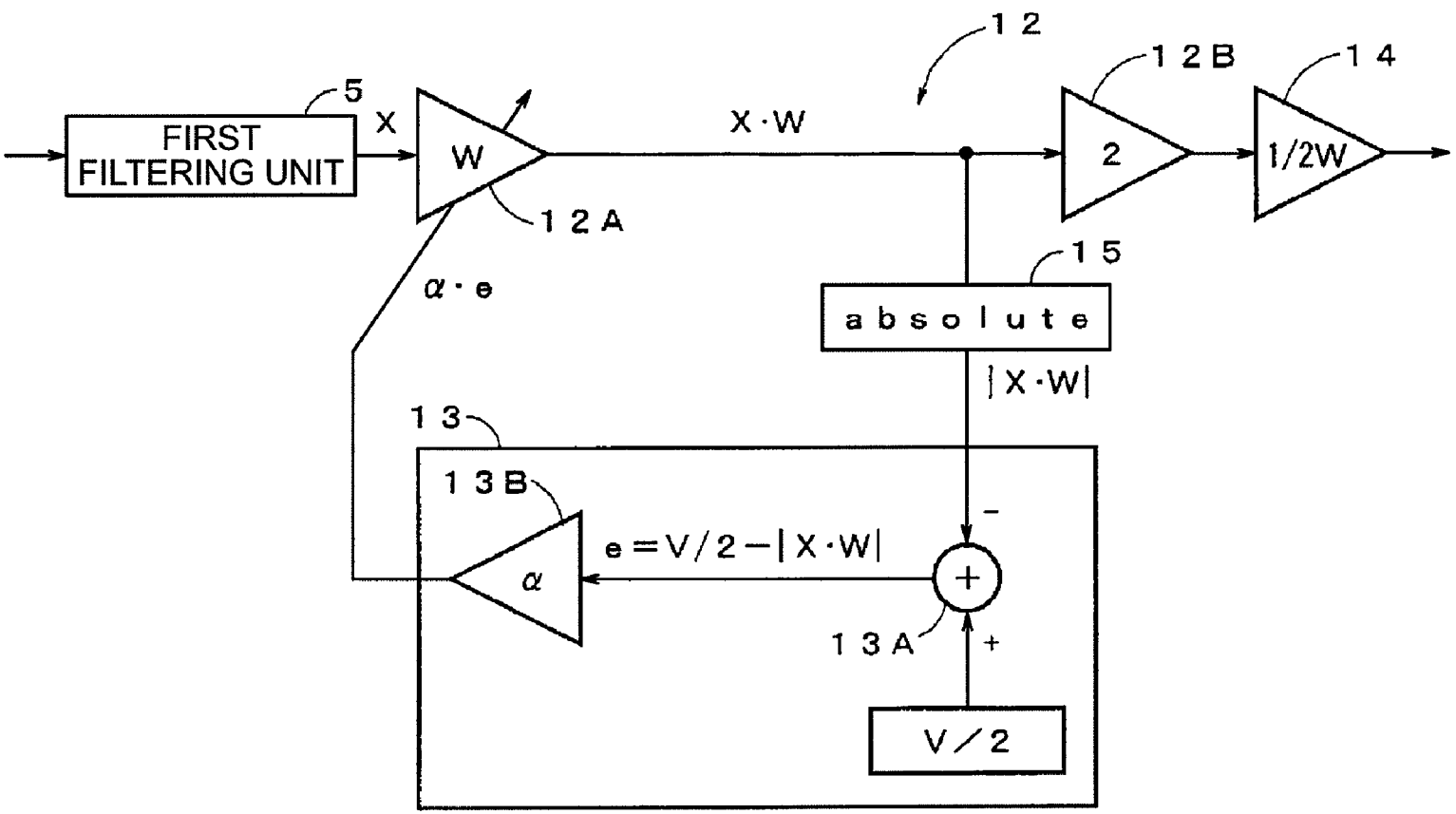
FIG. 7 A block diagram showing a detailed configuration of the first harmonic generating unit shown in FIG. 5.

Next, a configuration of the first harmonic sound generating unit 1 will be explained with reference to FIG. 7. As shown in FIG. 7, the first harmonic sound generating unit 1 includes: a first level correcting unit 12 as a first correcting means to multiple the signal level of the music signal by the correction coefficient 2W; a coefficient correcting unit 13 as a coefficient correcting means to correct the correction coefficient 2W so that the signal level of the music signal multiplied by the correction coefficient 2W is over the maximum value $X_{max}$ of the DSP 103; and a second level correcting unit 14 as a second level correcting means to multiple the signal level of the music signal by the reciprocal of the correction coefficient 2W.

The first level correcting unit 12 includes a first correction coefficient multiplying unit 12A as a first correction coefficient multiplying means to multiply the signal level x of the music signal by the first correction coefficient W; and a second correction coefficient multiplying unit 12B as a second correction coefficient multiplying means to multiply the signal level x multiplied by the first correction coefficient W (hereafter referred to as x·W) by 2 (equal to the second correction coefficient). Further, the coefficient correcting unit 13 corrects the first correction coefficient W so that the difference between x·W and the quotient of the target value divided by 2 (hereafter referred to as V/2) becomes zero. An absolute value unit 15 to output the absolute value of the signal level x multiplied by the first correction coefficient W (hereafter referred to as |x·W|) to the coefficient correcting unit 13 is interposed between the first correction coefficient multiplying unit 12A and the coefficient correcting unit 13. Incidentally, in this embodiment, the target value V is set to be higher than the maximum value $X_{max}$.

The coefficient correcting unit 13 includes: a subtracting unit 13A to subtract |x·W| from (V/2); and a correcting unit 13B to correct the first correction coefficient W by an adaptive signal processing so that x·W is moved close to V/2 based on α·e as a product of the subtraction e (=(V/2)−|x·W|) multiplied by a step size α.

W(n) is defined as a first correction coefficient at the time when correcting (n−1) times by the correcting unit 13C. W(n−1) is defined as the first correction coefficient at the time when correcting n times. Then, a relationship between W(n) and W(n−1) is shown in an equation (1). Incidentally, n is an arbitrary integer.

$$W(n) = W(n-1) + |x|\alpha e \tag{1}$$
$$= W(n-1) + |x|\alpha(V/2 - |x \cdot W|)$$

As it is clear from the equation (1), the coefficient correcting unit 13 corrects so that when |x·W| is larger than (V/2), αe becomes negative and the first correction coefficient W becomes smaller, when |x·W| is smaller than (V/2), αe becomes positive and the first correction coefficient W becomes larger. Further, when the difference between |x·W| and (V/2) is large, αe becomes large, and large αe is added to or subtracted from the first correction coefficient W. When the difference between |x·W| and (V/2) is small, αe becomes small, and small αe is added to or subtracted from the first correction coefficient W. Namely, the coefficient correcting unit 13 corrects the first correction coefficient W so that the product of the signal level x multiplied by the first correction coefficient W (|x·W|) is equal to V/2. Thus, the first correction coefficient multiplying unit 12A performs the level correction so that the signal level x of the music signal is moved close to V/2. The second correction coefficient multiplying device 11B performs the level correction so that the signal level x of the music signal is moved close to V.

Figure 8A:
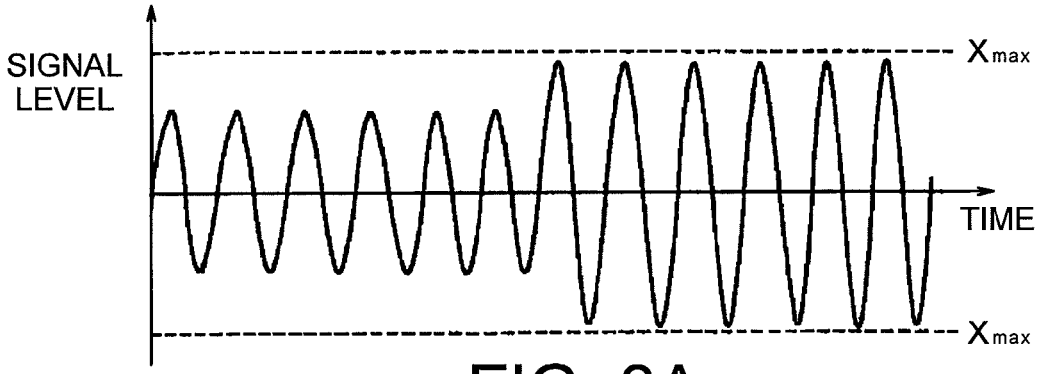
FIG. 8A A time chart showing a signal level of the music signal before a level correction is carried out by a first level correcting unit.

Next, signal processing operations in the DSP 103 will be explained with reference to FIGS. 8 to 11. Now, a sine wave music signal as shown in FIG. 8A is inputted into the DSP 103. Then, the first level correcting unit 12 corrects the signal level x by multiplying the signal level x by the correcting coefficient 2W so that the signal level x comes close to the target value V. Resultingly, as shown by a dotted line in FIG. 8B, the signal level x repeatedly overshoots and undershoots with respect to the target value V. The target value V is set larger than the maximum value $x_{max}$.

Figure 8B:
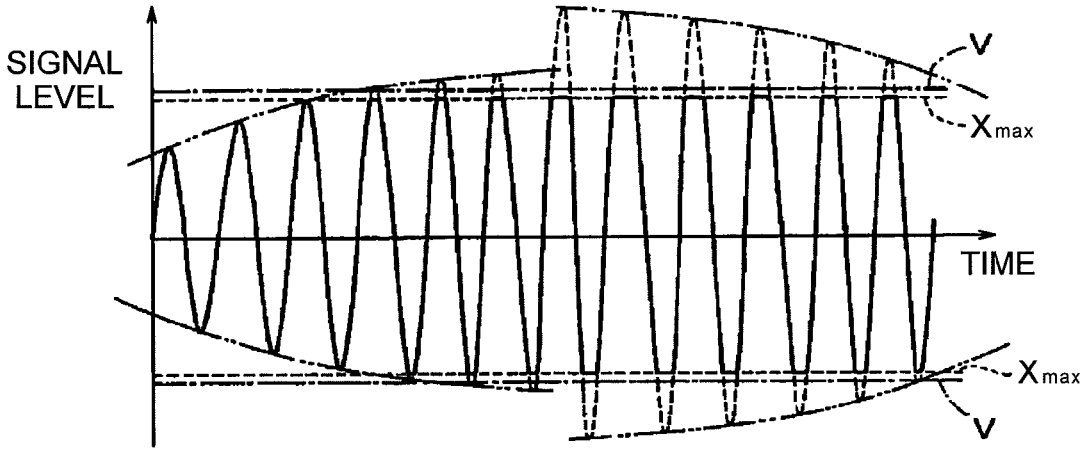
FIG. 8B A time chart showing the signal level of the music signal after the level correction is carried out by the first level correcting unit.
Figure 8C:
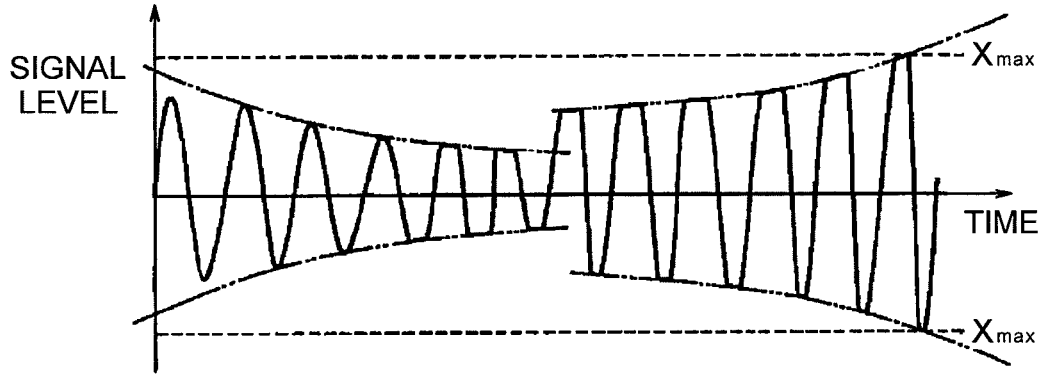
FIG. 8C A time chart showing a signal level of the first harmonic sound signal which is corrected by a second level correcting unit.

When the signal level is over the maximum value $x_{max}$, the DSP 103 overflows to suppress the signal level over the maximum value $x_{max}$ to the maximum value $x_{max}$. Accordingly, by the first level correcting unit 12, as shown in FIG. 8B, the range over the maximum value $x_{max}$ is distorted, and the music signal having the harmonic sound is attained. Then, the second level correcting unit 14 multiplies the signal level of the music signal shown in FIG. 8B by a reciprocal of the correcting coefficient 2W to return the signal level to the level before the first level correcting device 12 corrects. Thus, as shown in FIG. 8C, the signal level is distorted, and the first harmonic sound signal having the harmonic sound is attained. As it is clear from the above described, the DSP 103 corresponds to the harmonic sound generating device.

Incidentally, in this embodiment, the target value V is larger than the maximum value $x_{max}$. However, if the signal level overshoots the target value V and is over the maximum value $x_{max}$ due to the correction by the first level correcting unit 12, the target value V may be smaller than the maximum value $x_{max}$. Namely, the target value V is set so that the signal level of the music signal is over the maximum value $x_{max}$.

Figures 9A, 9B:
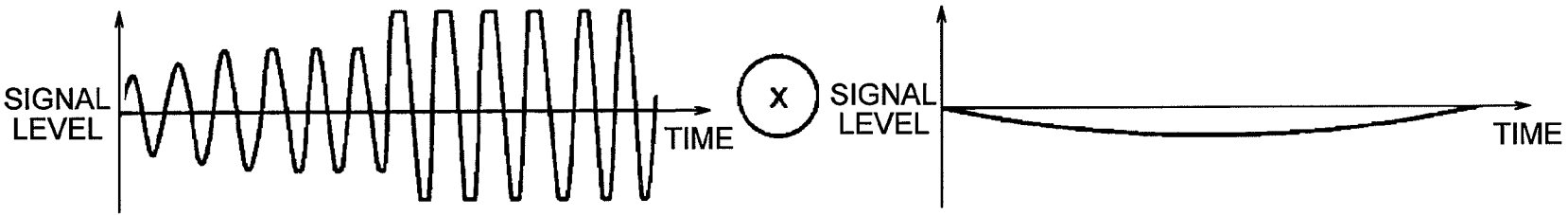
FIG. 9A A time chart of a waveform obtained by decomposing the first harmonic sound signal.
FIG. 9B A time chart of a waveform obtained by decomposing the first harmonic sound signal.

When a waveform of the first harmonic sound signal shown in FIG. 8C is decomposed, waveforms shown in FIGS. 9A and 9B are obtained. Namely, the first harmonic sound signal is expressed by a multiplication of the signal shown in FIG. 9A and a sine wave shown in FIG. 9B. When the signal shown in FIG. 9A is Fourier transformed, it is understood that odd numbered harmonics f, 3f, 5f . . . of an original music signal frequency f is generated. On the other hand, the first harmonic sound signal in FIG. 8C is fluctuated slowly as shown by two-dot chain line, and it is understood that a low frequency sine wave as shown in FIG. 9B exists. This is because the coefficient correcting unit 13 changes the correction coefficient 2W, and the first harmonic sound signal is multiplied by the signal corresponding to the changed frequency (specific frequency).

Generally, it is known that a frequency component of a signal as a product of a multiplication of two signals can be expressed by $(f_1+f_2)$, $(f_1-f_2)$ which is a convolution of frequency components $f_1$, $f_2$ of each signals. As described the above, the signal shown in FIG. 9A includes frequency components of odd multiples f, 3f, 5f . . . of the original music signal frequency f, and the sign wave shown in FIG. 9B includes frequency components of the specific frequency Δf. As shown in FIG. 6A, the first harmonic sound signal shown in FIG. 8C, which is a product of a multiplication of the signal in FIG. 9A and the sine wave in FIG. 9B, includes frequency components (f+Δf), (f−Δf), (3f+Δf), (3f−Δf), (5f+Δf), (5f−Δf) . . . . Namely, the first harmonic sound signal including frequency components of non-integer multiple shifted back and forth in Δf from the odd multiple is generated.

As it is clear from the above, the specific frequency Δf can be adjusted with the step size a of the correcting unit 13B. Namely, when the step size α is increased, the changed frequency of the correction coefficient 2W is increased, and the specific frequency Δf is increased. On the other hand, when the step size α is decreased, the changed frequency of the correction coefficient 2W is decreased, and the specific frequency Δf is decreased.

Figure 10:
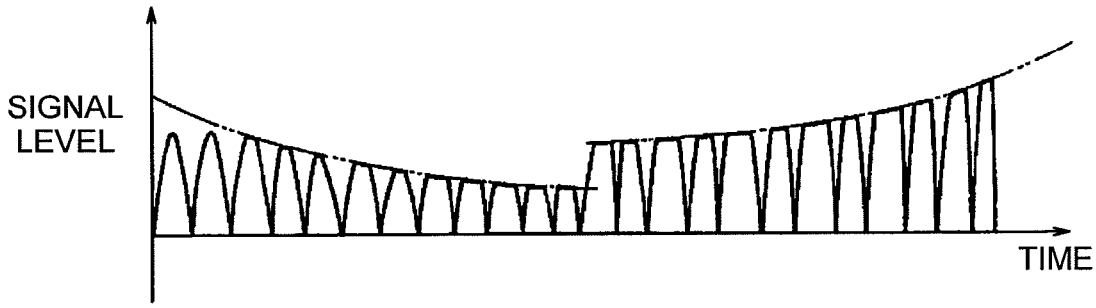
FIG. 10 A time chart showing a signal level of the second harmonic sound signal obtained by full-wave rectifying the first harmonic sound signal.
Figures 11A, 11B:
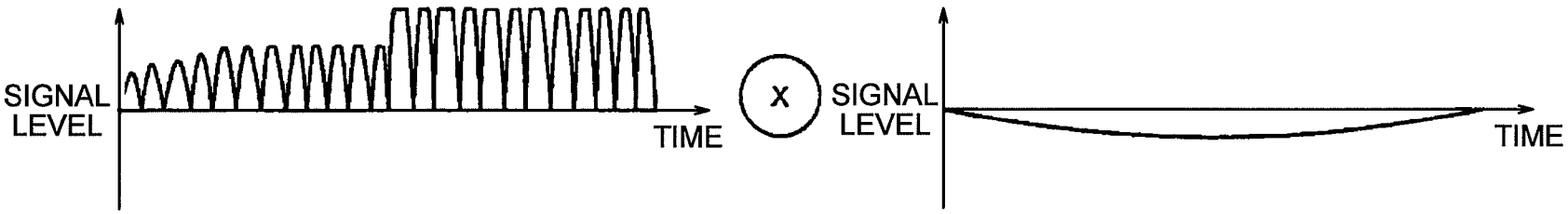
FIG. 11A A time chart of a waveform obtained by decomposing the second harmonic sound signal.
FIG. 11B A time chart of a waveform obtained by decomposing the second harmonic sound signal.

Further, when the full-wave rectifying unit 21 full-wave rectifies the first harmonic sound signal, the second harmonic sound signal shown in FIG. 10 is obtained. When decomposing the second harmonic sound signal, waveforms shown in FIGS. 11A and 11B are obtained. Namely, the second harmonic sound signal can be expressed by a multiplication of the signal shown in FIG. 11A and the sine wave shown in FIG. 11B. The waveform of FIG. 11A corresponds to the waveform of the signal FIG. 9A full-wave rectified.

The sine wave of FIG. 11B is the same as the sine wave of FIG. 9B. The signal shown in FIG. 11A includes frequency components of odd multiples 2f, 4f . . . of the original music signal frequency f. The second harmonic sound signal shown in FIG. 10C, which is a product of multiplication of the signal of FIG. 11A and the sine wave of FIG. 11B, includes frequency components of (2f+Δf), (2f−Δf), (4f+Δf), (4f−Δf), (6f+Δf), (6f−Δf) . . . as shown in FIG. 6B. Namely, the second harmonic sound signal including frequency components of non-integer multiple shifted back and forth in Δf from the frequencies of the odd multiple is generated.

Next, a total operation of the music playback unit 100 having the configuration described above will be explained. Firstly, the digital music signal read out from the recording media is inputted into the decoder 102 via the DIR 101. The decoder 102 decodes the coded music signal in a compression format such as MP3 or WMA, and supplies the decoded music signal to the DSP 103. The DSP 103 generates the frequency components of non-integer multiples shifted back and forth in a specific frequency from both odd and even multiples 2f, 3f, 4f . . . of the music signal as shown in FIG. 6D. The music signal to which the harmonic sound is added is then processed and outputted to the D/A converter 210.

The D/A converter 210 converts the digital music signal to which the harmonic sound component is added into the analog music signal, and outputs to the speaker 230 via the amplifier 220. Then, the speaker 230 reproduces the music signal to which the harmonic sound is added.

The music playback unit 100 includes: the first harmonic sound generating unit 1 to generate a first harmonic sound signal obtained by multiplying a signal including frequency components of odd multiples of the music signal by a signal of a specific frequency and to generate frequency components of non-integer multiples of the first harmonic sound signal sifted back and forth in the specific frequency from the odd multiples of the music signal; and the full-wave rectifying unit 21 to generate a second harmonic sound including frequency components of even multiples of the first harmonic sound signal. Namely, when the full-wave rectifying unit 21 as the second harmonic sound generating unit 2 generates the second harmonic sound signal including the frequency components of the even multiples of the first harmonic sound signal including the frequency components of the non-linear multiples of the music signal, the second harmonic sound signal including the frequency components of the non-integer multiple shifted back and forth in the specific frequency Δf from the even multiples of the music signal is obtained. Therefore, a configuration for generating frequency components of the non-integer multiples is only installed on the first harmonic sound generating unit 1, and as the second harmonic sound generating unit, only the full-wave rectifying unit 21 having a simple configuration can generate the frequency components including the non-integer multiples of the music signal shifted back and forth from both the odd and even multiples of the music signal. Further, a shift length Δf of the first harmonic sound signal relative to the odd multiple can be the same as that Δf of the second harmonic sound signal relative to the even multiple.

Further, according to the music playback unit 100, a method for generating harmonic sound of the music signal includes the steps of generating a first harmonic sound signal which is a product made by multiplying a specific frequency and a signal including frequency components of odd multiples of the music signal; making the first harmonic sound signal generate frequency components of non-integer multiples shifted back and forth in the specific frequency from the frequency of the odd multiples; and generating the second harmonic sound signal including frequency components of odd multiples of the first harmonic sound signal. Therefore, a configuration for generating frequency components of the non-integer multiples is only installed on the first harmonic sound generating unit 1, and as the second harmonic sound generating unit, only the full-wave rectifying unit 21 having a simple configuration can generate the frequency components including the non-integer multiples of the music signal shifted back and forth from both the odd and even multiples of the music signal. Further, a shift length Δf of the first harmonic sound signal relative to the odd multiple can be the same as that Δf of the second harmonic sound signal relative to the even multiple.

Further, the DSP 103 of the music playback unit 100 can separately generate the first harmonic sound signal (odd-order harmonic sound) including the frequency shifted back and forth from the add multiple and the second harmonic sound signal (even-order harmonic sound) including the frequency shifted back and forth from the even multiple. Therefore, by adjusting amplified gains of the first and second amplifiers 6, 7, the balance between the odd-order and the even-order harmonic sounds can be easily controlled.

Further, when the adding unit 4 for adding the music signal to the first and second harmonic sound signals is installed on the DSP 103, the frequency components of non-integer multiple shifted back and forth from the even and odd multiples can be added to the music signal.

Further, according to the DSP 103, because the second harmonic sound generating means is composed of the full-wave rectifying unit 21 for full-wave rectifying the first harmonic sound signal, the second harmonic sound signal can be generated with a simple structure.

According to the DSP 103, because the coefficient correcting unit 13 changes the correction coefficient 2W, as shown in FIGS. 9A and 9B, the first harmonic sound signal can be multiplied by the signal corresponding to the changed frequency. Therefore, frequency components of non-integer multiples shifted back and forth in the changed frequency (specific frequency) from the odd multiples can be generated. Further, even the music signal of a small signal level is larger than the maximum value $x_{max}$ of the DSP 103 by the level correction of the first level correcting unit 12. Therefore, surely the harmonic sound generating unit 11 generates the harmonic sound while regulating the signal level of the music signal. Namely, even with the music signal of the small signal level, the harmonic sound can be surely generated. Further, because the harmonic sound can be generated by an overflow of the DSP 103, the harmonic sound can be generated without non-linear operation of the DSP 103, and with a little arithmetic processing of the DSP 103.

Further, according to the DSP 103, the first level correcting unit 12 multiplies the correction coefficient 2W twice by the first correction coefficient multiplying unit 12A and the second correction coefficient multiplying unit 12B. Then, the coefficient correcting unit 13 corrects the first correction coefficient W so that x·W is smaller than the target value V. For example, when the coefficient correcting unit 13 corrects the first correction coefficient W so that x·W is equal to the target value V, at the time the signal level is multiplied by the first correction coefficient W, the signal level becomes larger than the maximum value $x_{max}$. Further, the coefficient correcting unit 13 corrects the correction coefficient so that the difference between the maximum value and the target value V becomes zero. Resultingly, the coefficient correcting unit 13 cannot correct the correction coefficient so that the difference between x·W and the target value V becomes zero. However, according to this embodiment, even when the target value V is set close to the maximum value $x_{max}$, at the time the signal level is multiplied by the first correction coefficient W, the signal level can be smaller than the maximum value $x_{max}$, and the coefficient correcting unit 13 can correct the first correction coefficient W without receiving the influence of the overflow of the DSP 103.

Further, according to the DSP 103, the first filtering unit 5 extracts only the specific frequency range from the music signal. Then, the harmonic sound component of the extracted specific frequency range of the music signal is generated. Then, the second filtering unit 8 removes the specific frequency range and extracts only the harmonic sound component. Finally, the second adding unit 4B adds the harmonic sound component to the original music signal. According to the above, the music signal in which a specific frequency range is emphasized among frequency ranges composing the music signal can be obtained. For example, when the specific frequency range is set to the vocal range, the vocal range of the music signal is emphasized. When the specific range is set to the bass range, the bass range of the music signal is emphasized.

Incidentally, in this embodiment, the harmonic sound of the music signal compressed in the compression format of MP3 and WMA is generated. However, the present invention is not limited to this. For example, the harmonic sound of the music signal of which high frequency range is cut such as the music signal recorded in a CD has the same effect.

Further, according to this embodiment, the full-wave rectifying unit 21 is used as the second harmonic sound generating means. However, the present invention is not limited to this. As the second harmonic sound generating means, a device for generating even multiples of the frequency of the inputted signal can be used, and such as a zero crossing method, or a power method can be used.

Further, according to this embodiment, as the first harmonic sound generating means, a device to generate the first harmonic sound as a product of a multiplication of the signal including the frequency components of the odd multiples of the music signal and the changed frequency (specific frequency) of the correction coefficient 2W is used by changing the correction coefficient 2W. However, the present invention is not limited to this. For example, the first harmonic sound generating means may be composed of an odd-order harmonic sound generating unit to generate harmonic sound including the frequency components of the odd multiples of the music signal, and a multiplier unit to multiply the music signal before the odd-order harmonic sound generating unit generates the frequency components of the odd multiples, or the harmonic sound generated by the odd-order harmonic sound generating unit by the sine wave (signal) of the specific frequency. As the odd-order harmonic sound generating unit, various devices are suggested, such as a compressor to generate the frequency of the odd multiple by distorting the waveform, or a peak hold circuit.

Further, according to this embodiment, the adding unit 4 adds the first and second harmonic sound signals and then adds the additional signal to the music signal. However, the present invention is not limited to this. The adding unit 4 may add the first and the second harmonic sound signals to the music signal. For example, the adding unit 4 may separately adds the first and second harmonic sound signal to the music signal.

Incidentally, according to the above embodiment, the harmonic sound is generated due to the overflow of the DSP 103. However, the present invention is not limited to this. For example, the harmonic sound may be generated by embedding a program for operating a non-linear function to limit the signal level to the specific value in the DSP 103. In this case, the specific value is set to be less than the maximum value $x_{max}$, and the first level correcting device 12 corrects the signal level of the music signal by multiplying the signal level by the correction coefficient so that the signal level of the music signal becomes over the specific value, thereby the harmonic sound is generated due to the non-linear operation of the DSP 103.

Further, when the specific value is less than the maximum value $x_{max}$, the first level correcting unit 12 may be composed of a correction coefficient multiplying unit to multiply the signal level by the correction coefficient and a coefficient correcting unit for correcting the correction coefficient so as to make a difference between a product of multiplying the signal level by the correction coefficient and the target value zero.

Further, an analog compressor having the input-output characteristic to limit the signal level to the specific level may be used as the harmonic sound generator. In this case also, the specific value is set to be less tan the maximum value $x_{max}$, and the first level correcting unit 12 of the DSP 103 corrects the signal level of the music signal by multiplying the signal level by the correction coefficient so as to make the signal level over the specific value. Then, the music signal corrected by the first level correcting device 12 is D/A converted to the analog music signal. Then, the analog music signal is supplied to the analog compressor, thereby the harmonic sound is generated.

Further, according to the above embodiment, in the second correction coefficient multiplying unit 12B, two is multiplied as the second correction coefficient, however, the present invention is not limited to this. As the second correction coefficient, any value can be used as long as the target value V divided by the second correction coefficient is less than the maximum value $x_{max}$.

Further, according to the above embodiment, the first and second level correcting units 12, 14 are composed of the DSP 103. However, the present invention is not limited to this. The first and second level correcting units 12, 14 may be composed of an analog circuit which works as same as the DSP 103.

Further, according to the above embodiment, in the first level correcting device, an error e is used as an evaluated value for moving the signal level x close to the target value V/2.

However, the present invention is not limited to this. For example, as the evaluated value, a square error $e^2$ can be used, and the first correction coefficient W may be corrected so as to make the square error $e^2$ zero. Namely, as the first level correcting device, any algorism can be used unless it is against the object of the present invention.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A harmonic sound generator for generating harmonic sound of a music signal comprising:

a first harmonic sound generating unit for generating a first harmonic sound signal including frequency components of non-integer multiples of a music signal frequency, said frequency components of the first harmonic sound signal being shifted back and forth within an offset range of odd-multiples of the music signal frequency, said offset range of odd-multiples based on a first specific frequency; and a second harmonic sound generating unit for generating a second harmonic sound signal including frequency components of non-integer multiples of the music signal frequency, said frequency components of the second harmonic sound signal being shifted back and forth within an offset range of even-multiples of the music signal frequency, said offset range of even-multiples based on a second specific frequency, said second harmonic sound generating unit generating the second harmonic sound signal based on the first harmonic sound signal generated by the first harmonic sound generating unit, wherein the first harmonic sound generating unit is composed of:

a digital signal processor to perform a digital signal processing of the music signal and to limit the signal level to a maximum value when the signal level is larger than the maximum value of the signal level processable by the digital signal processor, and wherein the digital signal processor comprises:

a first level correcting unit to perform a level correction by multiplying the signal level of the music signal by a correction coefficient so that the signal level of the music signal is larger than the maximum value; and a second level correcting unit to perform the level correction by multiplying the signal level of the music signal corrected by the first level correcting unit by the reciprocal of the correction coefficient, and wherein the first level correcting unit comprises:

a first correction coefficient multiplying unit to multiply the signal level of the music signal by a first correction coefficient;

a second correction coefficient multiplying unit to multiply the signal level multiplied by the first correction coefficient by a second correction coefficient; and a coefficient correcting unit to correct the first correction coefficient so that the difference between the signal level multiplied by the first correction coefficient and a predetermined target value divided by the second correction coefficient becomes zero.

2. The harmonic sound generator as claimed in claim 1, further comprising an adding unit to add both the first and second harmonic sound signals to the music signal.

3. The harmonic sound generator as claimed in claim 1, wherein the second harmonic sound generating unit is composed of a full-wave rectifying unit for full-wave rectifying the first harmonic sound signal.

4. The harmonic sound generator as claimed in claim 2, wherein the second harmonic sound generating unit is composed of a full-wave rectifying unit for full-wave rectifying the first harmonic sound signal.

5. The harmonic sound generator as claimed in claim 1, wherein the first specific frequency and the second specific frequency are equal.

6. A method for generating harmonic sound of a music signal comprising the steps of:

generating a first harmonic sound signal including frequency components of non-integer multiples of a music signal frequency, said frequency components of the first harmonic sound signal being shifted back and forth within an offset range of odd-multiples of the music signal frequency, said offset range of odd-multiples based on a first specific frequency;

generating a second harmonic sound signal including frequency components of non-integer multiples of the music signal frequency, said frequency components of the second harmonic sound signal being shifted back and forth within an offset range of even-multiples of the music signal frequency, said offset range of even-multiples based on a second specific frequency, said generating the second harmonic sound signal is based on the first harmonic sound signal;

performing a digital signal processing of the music signal and limiting the signal level to a maximum value when the signal level is larger than the maximum value of the signal level processable by a digital signal processor;

performing a level correction by multiplying the signal level of the music signal by a correction coefficient so that the signal level of the music signal is larger than the maximum value;

performing the level correction by multiplying the corrected signal level of the music signal by the reciprocal of the correction coefficient, and multiplying the signal level of the music signal by a first correction coefficient;

multiplying the signal level multiplied by the first correction coefficient by a second correction coefficient; and correcting the first correction coefficient so that the difference between the signal level multiplied by the first correction coefficient and a predetermined target value divided by the second correction coefficient becomes zero.

7. The method as claimed in claim 6, wherein the first specific frequency and the second specific frequency are equal.

* * * * *